US005732926A

United States Patent [19]

Baumgartner

[11] Patent Number: 5,732,926

[45] Date of Patent: Mar. 31, 1998

[54] CHRISTMAS TREE STAND

[76] Inventor: Gerald Baumgartner, 1701 W. Madison St., Sioux Falls, S. Dak. 57104

[21] Appl. No.: 675,106

[22] Filed: Jul. 3, 1996

[51] Int. Cl.[6] ..... F16M 13/00

[52] U.S. Cl. ..... 248/524; 248/528; 47/40.5

[58] Field of Search ..... 248/523, 524, 248/528; 47/40.5, 42, 43

[56] References Cited

U.S. PATENT DOCUMENTS 5,375,808 12/1994 Roy ..... 248/523

5,492,302 2/1996 Odom ..... 248/524

5,590,865 1/1997 Odom ..... 248/524

*Primary Examiner*—Peter M. Cuomo

*Assistant Examiner*—Gerald A. Anderson

[57] ABSTRACT

For cut Christmas trees, a stand having a readily adjustable trunk holder which can be adjusted to move the tree to the desired vertical position. The stand is collapsible for storage by folding the legs. A unique means for holding the tree in the stand is also provided.

8 Claims, 2 Drawing Sheets

CHRISTMAS TREE STAND

BACKGROUND AND SUMMARY OF THE INVENTION

This invention pertains to stands adapted to hold a cut tree such as is commonly used and decorated at Christmas time, and more particularly to a stand which can be collapsed for shipping and storage and which is more stable and more adaptable for tree watering than are prior cut stands.

Prior stands for Christmas trees are of varying types. Some are simply crossed legs using guy wires to hold the tree in its desired (usually near vertical) position. These stands have variants in which the trunk of the tree may be pegged, by a nail or the like, to the cross of the legs, or in which a bucket of wet sand is held in place on the legs and the trunk is inserted into the sand.

Another type of stand includes a series of legs extending from a central container adapted to receive the trunk of the tree and to surround it with water. Some device to press the tree trunk to hold it is usually provided at a level above the bottom of the trunk so as to hold the trunk nearly vertical.

By the present invention, a stand is provided in which the cut end of the trunk of the tree can easily be immersed in a relatively large pan of water. The stand has a capacity for a wide range of trunk diameters and the stand itself has the possibility of adjustment to maintain the verticality of the tree. The legs of the stand collapse for easy storage and portability.

DESCRIPTION

Figure 1:
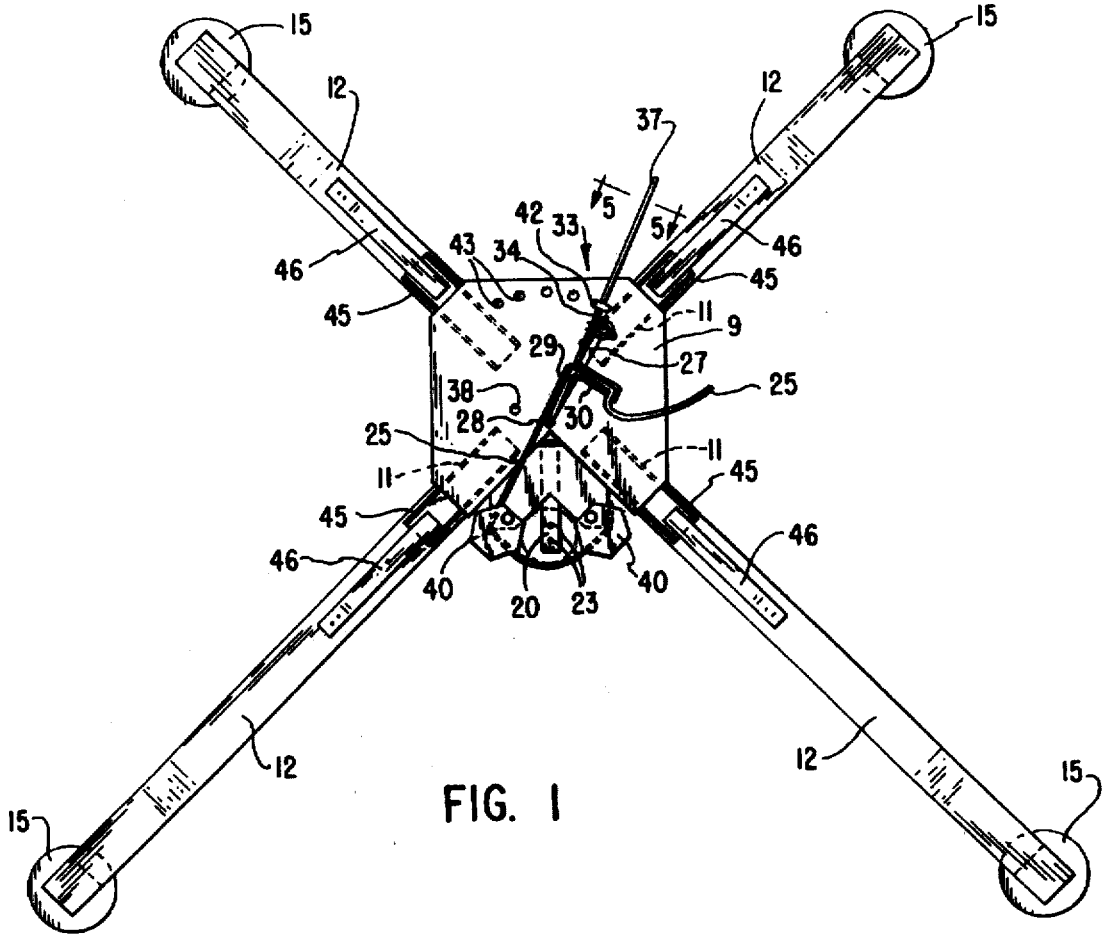
FIG. 1 is a top plan view of the stand in the position as used.

Briefly this invention comprises a stand for holding a cut tree in which the tree trunk has the cut end standing in a pan, while the trunk is securely supported by the stand.

More particularly, the stand includes a central platform 10 composed of four platform legs 11 disposed in a cross shape and fastened to a plate 9. Each leg has an inverted channel shaped cross section to receive the extended legs 12 which form the support for the device. Each of the extended legs 12 is pivotally attached to a platform leg 11 by a pin 13 (FIG. 4) so that it can be moved from the support position shown in full line in FIG. 4 to the shipping or storage position shown by the dotted lines in that same figure.

The extended legs 12 are formed with a downward extending portion 14 which terminates in a foot pad 15 adapted to spread the load over a wider area of the floor or floor covering than the end of the leg portion. The elevation of the platform 9 caused by the bending down of the legs provides a substantial space under the platform. Preferably this space is sufficient for the placement of a pan 8 holding a substantial amount of water to be supplied to the tree.

Figure 4:
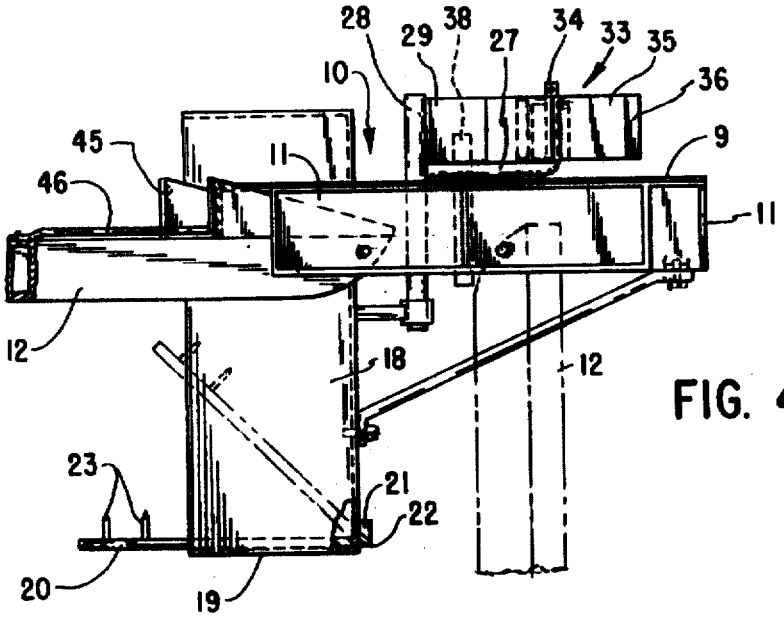
FIG. 4 is a detailed side elevational view of the parts shown in FIG. 3.

To hold the tree, a tree-holding bracket 18 is fixed to a pair of adjacent legs 11 and the platform 9. The bracket 18 depends to a point somewhat above the floor level as defined by the pads 15, but substantially below the platform 9. The socket is essentially angle-shaped so that it will support two sides of the trunk of the tree. At its lower end, the bracket 18 has a partial floor 19 (FIG. 4) adapted to support a removable tree support 20. This support may take the form of a strap having a turned up end 21 (FIG. 4). The end 21 may be hooked through an opening 22 in the bracket 18 so that it will be anchored in place when a tree is set on the support, but can be released by raising the support and pulling the end 21 from the opening 22. One or more pointed pins 23 may be provided on the support. These pins should extend into the base of the tree trunk to hold the trunk in place on the support.

Added holding for the trunk is provided by a strap 25 fixed to the bracket 18 and adapted to be wrapped around the trunk of the tree and the bracket 18. The unfastened end of the strap is engaged in a tightening device adapted to pull the straps tightly around the tree trunk.

Figure 3:
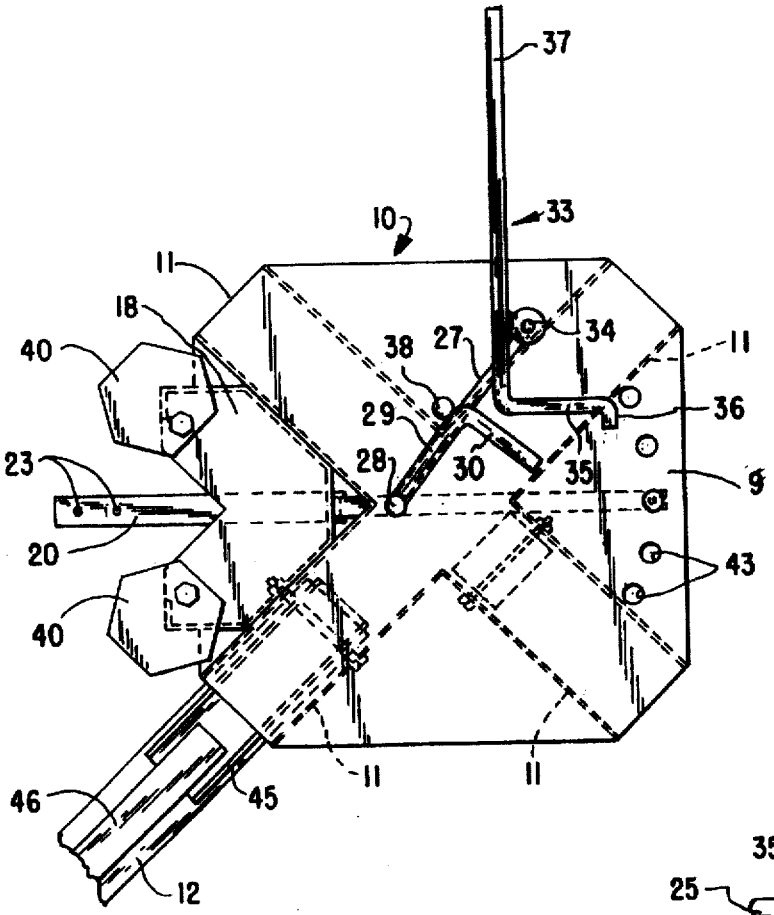
FIG. 3 is a detailed top plan view of the trunk holding mechanism in its open position with two legs removed for the sake of clarity.
Figure 5:
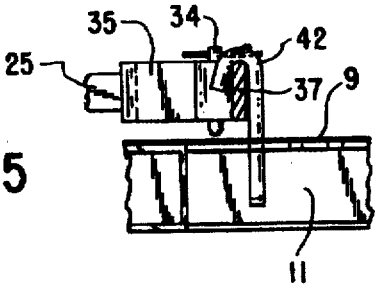
FIG. 5 is a detailed view from line 5—5 of FIG. 1.

The tightening device includes a base bar 27 pivoted in the platform 9 at a post 28. A plate 29 having one edge fixed to the bar 27 extends upwardly from the bar 27 a distance about equal to the width of the strap 26. This plate has an end 30 extending at a near right angle to the bar 27, thus forming a pad against which the strap may be pressed. A pressing plate 33 similar in width to the plate 29 is pivoted to the base bar at a pivot 34. The pressing plate 33 is elongated taking the shape of a metal bar. At one end, relatively close to the pivot 34, the bar takes the form of the letter "Z". The center of the Z-shape forms a pressure pad 35, and terminates in an end 36 at a right angle to the pad 35. These forms are located so that when the bar 33 is pivoted around its pivot 34 the pad 35 is in close proximity to the end 30. The proximity is such that the strap 25 will be pressed between the end 30 and the pad 35 in a tightly-held gripping relationship. The end 36, then serves both as an added holding device gripping the strap between it and the edge of the holding end 30, and as a stop to further motion of the bar 33. The pressing action is actuated by manually pulling on the handle end 37 of the bar 33. This handle extends substantially from the pivot 34 in a direction away from the pad 35. A peg 38 may be used as a stop to limit movement of the base bar 27 (FIG. 3).

In order to provide for trunks of varying diameters, and for those which may not be exactly straight, an adjustment device is provided. This device is embodied in a pair of multi-sided (illustrated as hexagonal) plates 40 pivoted off center. The plates 40 are carried by the platform 9, and are pivoted near the widest part of the angle-shaped bracket 18. The plates 40 are relatively thin—of the order of an eighth of an inch—so that they can be pressed into the wood of the trunk of the tree being held. It will be apparent that because of the off-centeredness, the position of the trunk at the level of the plates 40 can be adjusted somewhat. Because the trunk is pinned on the pins 23, the result will be a tilting of the trunk or an adjustment for irregularities in the shape of the trunk. In either case, the usefulness in adjusting the tree for display is obvious.

To use the trunk holding mechanism it is necessary first to engage the trunk with the pins 23. This can be done either by drilling a hole into the end of the trunk, or by driving the pin 23 into the trunk with a hammer. The trunk is then erected against the plates 40 and they can be adjusted to hold the trunk in the desired position as nearly as possible. The strap 25 is then pulled around the trunk and between the pads 30 and 35. The lever 37 is then used to press the pad 35 toward the pad 30 thus clamping the strap therebetween. Further pulling of the lever tightens the strap around the trunk to hold the tree in place. In order to hold the lever 37 in that position, a hook 42 is adapted to hook over the lever 37 and to extend through one of a series of holes 43 in the platform 9. The strap 25 is merely pulled tight and then the hook 42 is placed over the lever and dropped through the particular hole 42 which holds the strap tightest.

Figure 2:
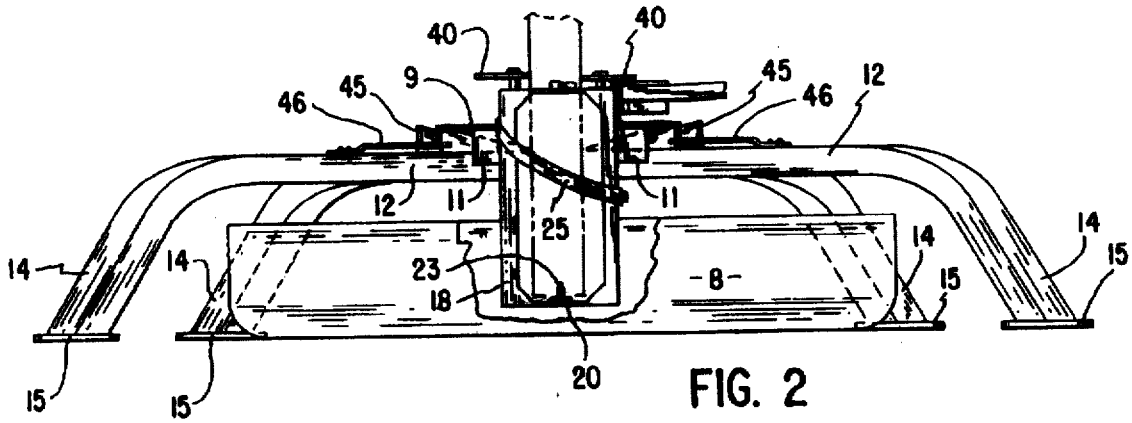
FIG. 2 is a side elevational view of the stand shown in FIG. 1.

Added adjustment means to keep the tree as near vertical as possible is also provided in connection with the legs. This feature includes a series of wedges 45 having a U-shaped cross section. The base of the U-shape is slidably disposed on the top of each of the legs 12 and the wedge is slidable under the inverted channel of the platform legs 11 (FIGS. 2 and 4). A springable tongue 46 on each leg 12 extends into the U-shape of the wedge 45 to hold it in place on the leg 12. That tongue may also be engaged with the wedge through any of a number of well-known ratchet devices to prevent outward sliding of the wedge after it has been inserted. As an alternative to a ratchet device, the sloping edges of the wedge may also be stepped so that the engagement between the wedge 45 and the platform leg 11 is always vertical. Thus, there is no component of force tending to eject the wedge.

The use of the wedge 45 in tilting the platform 10 is obvious from the description. The tilting of the tree in response to changes in the platform position will also be obvious. Thus, some adjustment of the position of the tree after its erection is readily possible by use of the wedge 45.

I claim as my invention:

1. A stand for holding a cut tree in an erect position comprising a platform, a series of legs pivotally connected to said platform, each of said legs being pivotal between a collapsed position for storage and shipping and a standing position, said legs in said standing position being extended outwardly from said platform, said legs each being formed with a downward extending portion terminating in a foot pad whereby said platform is elevated above the level of the foot pads when in the standing position, trunk receiving means on said platform to receive the trunk of said cut tree, said trunk receiving means including an angle-shaped bracket adapted to receive the trunk of said tree, support means at the bottom of said bracket to support said tree, adjustable means at the top of said bracket for contacting said trunk to hold it in an adjusted position, and strap means fastened around said trunk and said bracket to hold said trunk in said bracket, said strap means including a strap having a first end fixed to said bracket and a second end gripped by lever means, said lever means being pivotally mounted on said platform whereby pulling on said lever means tightens said strap about said trunk.

2. The stand of claim 1 in which said lever means includes a base bar pivotally mounted on said platform, a first pad means on said base bar, a lever arm pivotally mounted on said base bar, said lever arm including a second pad adapted to match said first pad means, movement of said lever arm being effective to press said pad and pad means together, said strap extending between said pad and said pad means thus being first clamped therebetween and subsequently pulled tight around said trunk.

3. The stand of claim 2 in which wedge means slidable relative to said first named legs are engaged between said platform legs and said first named legs to provide tilting adjustment of said platform relative to said first named legs.

4. The stand of claim 2 in which hook means is engageable between said lever arm and said platform to hold said lever arm in a fixed position.

5. The stand of claim 4 in which said platform is provided with a series of holes in position to receive said hook means, said hook means being adapted to extend into one of said holes to provide for an adjusted position in which said hook means holds said lever arm.

6. The stand of claim 1 in which said lever means includes matching pads adapted to be clamped onto said strap whereby said strap is held by said lever means.

7. A stand for holding a cut tree in an erect position comprising a platform, a series of legs pivotally connected to said platform, each of said legs being pivotal between a collapsed position for storage and shipping and a standing position, said legs in said standing position being extended outwardly from said platform, said legs each being formed with a downward extending portion terminating in a foot pad whereby said platform is elevated above the level of the foot pads when in the standing position, trunk receiving means on said platform to receive the trunk of said cut tree, said trunk receiving means including an angle-shaped bracket adapted to receive the trunk of said tree, support means at the bottom of said bracket to support said tree, adjustable means at the top of said bracket for contacting said trunk to hold it in an adjusted position, said adjustable means including multi-sided plates pivotally attached to said platform adjacent said bracket at a pivotal axis, said axis being eccentric to said plates, and strap means fastened around said trunk and said bracket to hold said trunk in said bracket.

8. The stand of claim 7 in which wedge means slidable relative to said first named legs are engaged between said platform legs and said first named legs to provide tilting adjustment of said platform relative to said first named legs.

* * * * *